United States Patent [19]

Satzinger

[11] 3,933,322

[45] Jan. 20, 1976

[54] METHOD AND APPARATUS FOR THE UNWINDING OF BANDS

[76] Inventor: Roland Satzinger, Hammelburger Str. 21 a, 8731 Euerdorf, Germany

[22] Filed: July 31, 1974

[21] Appl. No.: 493,932

[30] Foreign Application Priority Data

Aug. 9, 1973 Germany ..... 2340321

[52] U.S. Cl. ..... 242/55; 242/78.6

[51] Int. Cl.[2] ..... B65H 75/02

[58] Field of Search ..... 242/55, 76, 78.6, 78.7

[56] References Cited

UNITED STATES PATENTS

| | | | |
|---|---|---|---|
| 1,141,449 | 6/1915 | Eppler | 242/55 |
| 1,178,566 | 4/1916 | Wright | 242/55 |
| 2,066,488 | 1/1937 | Schmied | 242/55 |
| 3,218,000 | 11/1965 | Blackman | 242/76 |
| 3,411,728 | 11/1968 | Hall | 242/55 |
| 3,810,591 | 5/1974 | Haren | 242/78.6 |

*Primary Examiner*—Edward J. McCarthy
*Attorney, Agent, or Firm*—Burgess, Dinklage & Sprung

[57] ABSTRACT

A method for unwinding and simultaneously turning a band or the like from an unwinding reel on which it is wound, which reel has a vertical axis of rotation which comprises removing said band off of said reel in a horizontal direction, raising said band to a height above said reel in said horizontal direction and at said height turning said band about an angle of 90° and moving said band, while turned, in a direction opposite to that in which it was removed from said reel; an apparatus for unwinding and simultaneously turning a band from a reel having a vertical axis so that the major surface of the band runs horizontally which apparatus comprises a reel whose axis of rotation is vertical, a band guide disposed axially above said reel and transport means disposed downstream of said guide for removing band material on said reel and causing it to move in a horizontal direction opposite to that horizontal direction in which the band is removed from said reel to said guide.

9 Claims, 1 Drawing Figure

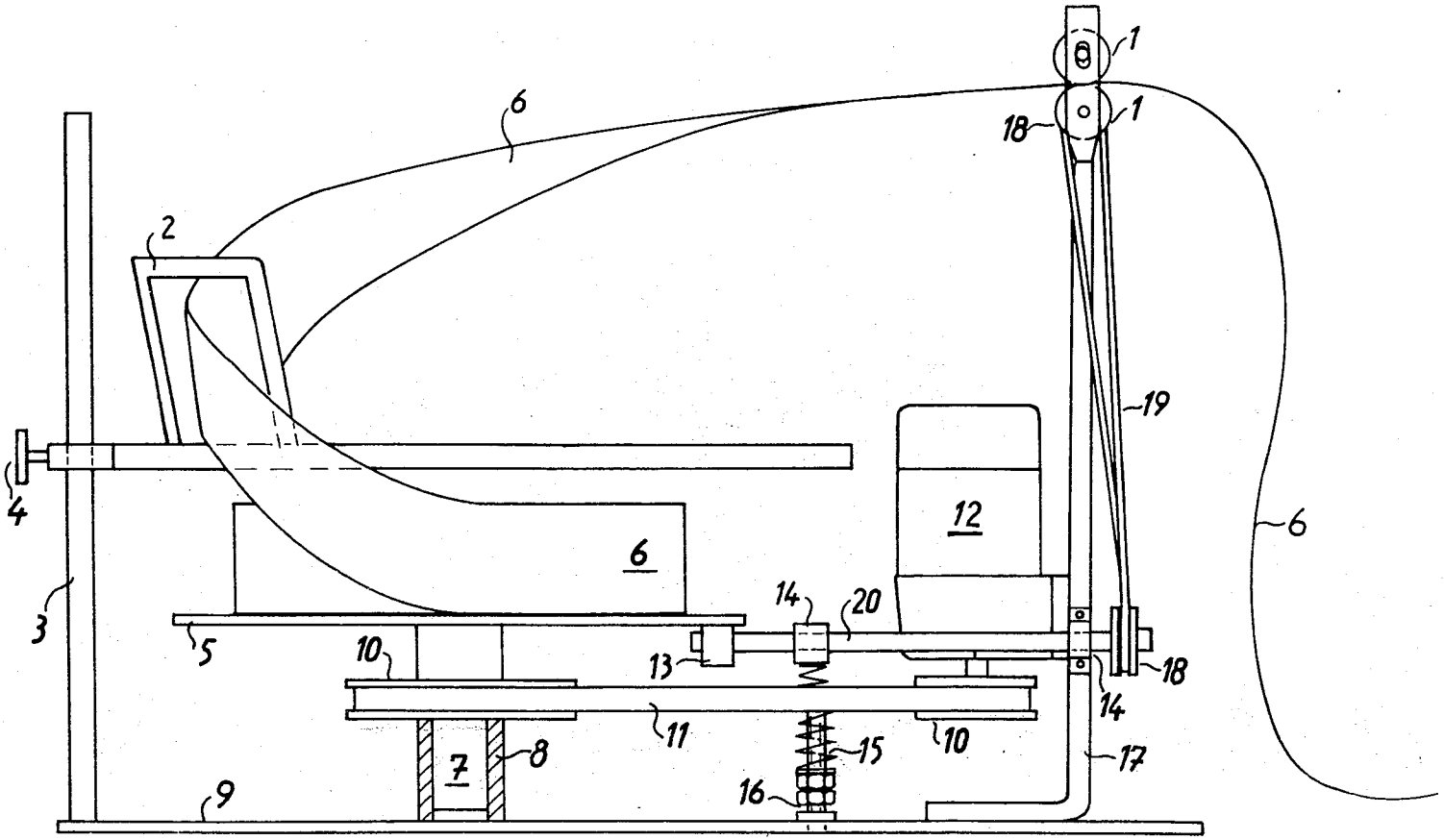
1
1
18
19
6
18
14
17
12
10
20
15
14
16
13
11
6
6
8
7
10
2
5
9
3
4

METHOD AND APPARATUS FOR THE UNWINDING OF BANDS

BACKGROUND OF THE INVENTION

1. Field of the Invention

The present invention concerns a method and an apparatus for the unwinding and simultaneous turning of bands or the like from a feed reel having a vertical axis of rotation. This invention also relates to an apparatus in which a vertically revolving reel is rotated on a turntable and means are provided for moving unwound band material horizontally at the same rate at which they are removed from the reel while lying in a vertical plane.

2. Discussion of the Prior Art

Feed reels whose purpose is to unwind reeled material in band form are already known. If coils of band material which are light in weight are involved, the material can be fed directly into the band fabricating machine, e.g., through feed rollers. It is difficult, however when larger reels weighing about 0.4 to 2.5 metric tons must be handled. In order to accelerate these weights and feed the band smoothly into the fabricating machine special measures are necessary.

As a rule such unwinding reels are constructed with a horizontal axis of rotation, which has the disadvantage that, in the case of an overhung mounting of the reel, the mounting must be of very strong construction, and furthermore covers or the like must be provided to prevent the material from running off laterally. Also, the pact of material must be biased inwardly by expensive means.

It is also known to construct the unwinding reel with a vertical axis of rotation and to lay the heavy reels of material on the flat turntable. Such reels are simpler and hence less expensive to construct and also easier to load. However, they have the disadvantage that the band is unwound in a vertical position from the reel, whereas most band fabricating machines are able to work the band only in the horizontal position. The band must therefore be twisted 90° before it enters into the fabricating machine.

A method and an apparatus has been disclosed by German Offenlegungsschrift 2,125,069 for winding a band of plastic on a spool, in which the plastic band is unwound from a reel having a horizontal axis of rotation and, after repeated passing around pulleys, situated laterally of the reel but still in the plane of the reel, it is twisted 90°. Aside from the fact that this known system has an unwinding reel with a horizontal axis of rotation and hence all of the above described disadvantages, it requires on the one hand a plurality of pulleys and guides as well as an expensive tensioning mechanism, and, on the other hand, it requires a very great amount of space in breadth and in length, which often is not available at the point of entry to the fabricating machine.

It is an object of this invention, therefore, to provide a method and apparatus for the unwinding and twisting of bands or the like from unwinding reel having a vertical axis of rotation. it is a further object of this invention to provide such an apparatus which does not entail substantial expenditure nor utilize an excessive amount of floor space. It is particularly an object of the present invention to provide such an apparatus which can be constructed at little expenditure and which consumes only a minor amount of floor space.

SUMMARY OF THE INVENTION

The objects of the present invention are provided by a process for unwinding and simultaneously turning a band or the like from an unwinding reel on which it is wound, which reel has a vertical axis of rotation, which method comprises removing said band off of said reel in a horizontal direction, raising said band to a height above said reel in a horizontal direction and, at said height, turning said band about an angle of 90° and moving said band, while turned, in a direction opposite to that in which it was removed from said reel.

The objects of the invention are accomplished by an unwinding assembly for the removal of a wound band from a reel having a vertical axis which assembly turns the unwound band so that its major surface runs horizontally, said assembly comprising a reel whose axis of rotation is vertical, a band guide disposed axially above said reel and transport means disposed downstream of said guide for removing band material on said reel and causing it to move in a horizontal direction opposite to that horizontal direction in which the band is removed from said reel to said guide.

It is thus seen that the objects of the present invention are provided by a method and apparatus in which the band is unwound from a reel which revolves about its vertical axis and is lifted from the plane of the reel of the material, usually disposed on a turntable having a vertical axis of rotation, and twisted by 90° at a position of elevation above the coil of material. It is at the point of twisting where the band material passes through a guide. It is twisted from a position in which its major surface lies in a vertical plane to a position where the major surface lies in a horizontal plane. It is thereafter caused to be moved in a horizontal direction opposite to that horizontal direction in which it was removed from the reel. It is pulled off in the opposite horizontal direction by use of a transport means such as a pair of opposed rollers urged together by use of a spring or weight to define a nip therebetween. Thus, the band material forms a loop as it is withdrawn from the coil or reel in which it has orginially been wound. After it passes through, a transport means, e.g., a pair of rollers, it can be fed to a band fabricating machine.

The apparatus of the invention is further characterized by having an adjustable band guiding means disposed axially above the turntable in the area of the outside diameter of the reel of band material disposed thereon. The transport rollers move the band material in a substantially horizontal direction inasmuch as they rotate about a horizontal axis. The transport rollers have a axis of rotation which is substantially diametrically opposite to that of the reel of the band material or the turntable upon which such reel is disposed. The band material can be caused to move through a guide means disposed horizontally above the reel of band material which guide can be in the form of a rectangular member disposed above the outer periphery of the wound reel such that it lies in the same vertical plane with the periphery of the wound band material.

By the present invention a new band feed by transport roller is provided which allows the material to be twisted by 90° above the coil or reel of material and then guided into the transport rollers. The band of material is then transported to a band loop between the unwinding reel and the fabricating machine, where it is sensed by known sensing levers, photoelectric cells or noncontacting switches which control the unwinding reel. The turntable can be driven by means of a self-braking motor provided with an electrical transmission.

Since as the coil of material unwinds the coil diameter constantly diminishes, the turntable is caused to rotate faster or more frequently, as the case may be, but the transport rollers feed the band therethrough at the same speed. Only through transport rollers which are driven in accordance with the turntable rotation can one achieve such operation with the many advantages.

In order to be able to handle left-wound or right-wound coils of material, the self-braking motor is reversible construction, but the transport rollers are always driven in the same direction. This variation can be done, for example, by turning the V-belt 19 shown in the drawings and discussed below.

In order to be able to adjust the pull of the transport rollers on the band of material from the coil down to the dimensions and characteristics of the material, the drive of the transport rollers is made adjustable in torque. This is achieved by the adjustment of the spring pressure on the shaft or on the friction wheel of the transport roller drive, as the case may be.

BRIEF DESCRIPTION OF THE DRAWINGS

The invention can be more readily understood and appreciated when reference is made to the accompanying drawings depicting a specific embodiment of the invention. Referring to the drawing, the same is a side elevational view of a wound reel containing band material disposed on a turntable and showing the path of the band material 6 as it is unwound from the reel.

DESCRIPTION OF SPECIFIC EMBODIMENT

Referring to the accompanying drawing, the band material 6 is disposed on a reel shown to be disposed over a turntable 5. Turntable 5 in turn is mounted co-axially with a shaft 7 which is maintained within a bearing sleeve 8 which in turn rests upon a base plate 9. Also disposed on base plate 9 is a mast 3 on which there is a band guide 2 height adjustably situated. There is also disposed on base plate 9 an upright 17 to which there is also fastened the motor 12 for driving the turntable 5 and the transport rollers 1.

The band guide 2 is height adjustably situated on the mast 3 by the use of a set screw 4 which serves to lock the band guide 2 to the mast. Thus, the apparatus can be used for the removal of any size of band material simply by raising or lowering, as the case may be, the band guide 2 by loosening the set screw and moving the same along the mast to the proper point. The band guide 2 is also adjustable transversely so as to adapt to the diameter of the coil of material.

The motor 12 is a self-braking gear motor which drives the turntable 5 through a V-belt pulley 10 and the V-belt 11. The transport rollers 1 are driven by the shaft 20 mounted in bearings 14, the V-belt pulley 18 and the V-belt 19. The shaft 20 is driven by virtue of rotation of the turntable 5. Turntable 5 is in frictional engagement with the friction wheel 13 so that rotation of turntable 5 causes rotation of friction wheel 13. Rotation of friction wheel 13 causes co-axial rotation of shaft 20 which thereby causes rotation of the V-belt pulley 18. Motion is transmitted to a pulley co-axial with transport roller 1 through use of a V-belt 19 shown to be a cross-over to effect a change in the axis of rotation from the axis of rotation shown by shaft 20 to the axis of rotation of roller 1. The torque of the transport rollers 1 can be adjusted by a compression spring 15 by means of the nuts 16 disposed on the threaded shaft.

The band material 6 to be unwound lies in the form of a reel on the turntable 5 and is guided by the band guide 2 over the turntable 5 and, after being turned 90°, is fed through the nip of the opposed and facing transport rollers 1 having a horizontal axis of rotation. The band material 6 emanating from the nip of the rollers 1 can then be delivered in a loop to the input of a fabricating machine (not shown). This loop can be sensed by known sensing levers, photoelectric cell systems or non-contacting switches. Thus, the unwinding reel can be controlled in accordance with the consumption of the bands by the fabricating machine.

In the construction of the assembly shown, the transport rollers 1 should be at least as long as the band 6 is wide. This prevents any undue folding of the band material 6 as it passes through the nip of the rollers 1. The upper transport roller 1 can be held in an elongated hole, as shown, and can be pressed against the lower transport roller 1 by gravity. Alternatively a weight or a spring force can urge the rollers together. The lower transport roller 1 is driven by means of the V-belt pulley 18 coaxially with the shaft of the lower transport roller 1 so that the lower transport roller 1 is the first moved roller. These rollers can be adapted automatically to various band thicknesses by the adjustment of spring pressure or weights.

It will be understood that the apparatus of the present invention can be used for the removal of virtually any type of stock from a reel. The invention is particularly concerned with the removal of band material from a vertically disposed reel. The term "band" material refers to material having a width substantially greater than their thickness and having an indeterminant length, i.e., a continuous length. The term "band" material contemplates materials such as sheets. Generally band materials have a thickness no greater than about 3cms. and have a width of substantial multiples thereof.

What is claimed is:

1. A method for unwinding and simultaneously turning a band or the like from an unwinding reel on which it is wound, which reel has a vertical axis of rotation which comprises removing said band off of said reel in a horizontal direction, raising said band to a height above said reel in said horizontal direction and, at said height, turning said band about 90° and moving said band, while turned, in a direction opposite to that in which it was removed from said reel.

2. An unwinding assembly for the removal of a wound band from a reel having a vertical axis and turning the unwound band material so that its major surface runs horizontally comprising a reel whose axis of rotation is vertical, a band guide disposed axially above said reel and transport means disposed downstream of said guide for removing band material on said reel and causing it to move in a horizontal direction opposite to that horizontal direction in which the band is removed from said reel to said guide.

3. An assembly according to claim 2 wherein said transport means comprises at least one pair of rollers in face-to-face relationship to define a nip therebetween, said rollers having a horizontal axis.

4. An assembly according to claim 2 wherein said reel is disposed on a revolvable turntable which revolves about its vertical axis.

5. An assembly according to claim 4 wherein said transport means comprises at least one pair of rollers in face-to-face relationship to define a nip therebetween, said rollers having a horizontal axis, said assembly further comprising driving means for driving said turntables and at least one of said rollers, said means operable to drive said rollers at a rate proportional to the rate at which said turntable is driven.

6. An assembly according to claim 5 wherein said driving means comprises a motor having a driven revolvable shaft said shaft interconnected axially with a first pulley, said turntable has a shaft positioned axially of its vertical axis and having a second pulley axially connected thereto, the first pulley and the second pulley interconnected by a belt, said assembly further comprising a friction wheel engaged against said turntable and revolvable in response to revolution of said turntable, said friction wheel having an axially running shaft terminating in an axially disposed third pulley, one of said rollers interconnected axially with a fourth pulley, said third and fourth pulley interconnected by a belt.

7. An assembly according to claim 5 wherein said assembly further comprises a guiding mast on which said guide means is height adjustably mounted.

8. An assembly according to claim 5 comprising means for urging said rollers toward one another.

9. An assembly according to claim 8 wherein said means for urging said roller towards one another comprises a spring.

* * * * *